US007140334B2

(12) United States Patent
Segawa et al.

(10) Patent No.: US 7,140,334 B2
(45) Date of Patent: Nov. 28, 2006

(54) VALVE TRAIN FOR INTERNAL COMBUSTION ENGINE

(75) Inventors: Makoto Segawa, Saitama (JP); Yasuaki Asaki, Saitama (JP); Toshihiro Akiwa, Saitama (JP); Masashi Kawamata, Saitama (JP); Junya Iino, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/867,818

(22) Filed: Jun. 16, 2004

(65) Prior Publication Data

US 2004/0255887 A1 Dec. 23, 2004

(30) Foreign Application Priority Data

Jun. 17, 2003 (JP) ..... P.2003-172310

(51) Int. Cl.
*F01L 1/34* (2006.01)

(52) U.S. Cl. ..... 123/90.16; 123/90.17; 123/345

(58) Field of Classification Search ..... 123/90.16, 123/90.27, 90.31, 90.39, 90.4, 90.44, 90.6, 123/90.15, 90.17, 90.18, 345, 346, 347, 348; 74/559, 567, 568, 569
See application file for complete search history.

(56) References Cited

U.S. PATENT DOCUMENTS 4,151,817 A * 5/1979 Mueller ..... 123/90.16
4,936,266 A 6/1990 Imajo ..... 123/90.17
5,429,079 A * 7/1995 Murata et al. ..... 123/90.16
2002/0059911 A1* 5/2002 Takahashi et al.

FOREIGN PATENT DOCUMENTS

| | | |
|---|---|---|
| DE | 43 03 789 A | 8/1994 |
| EP | 0 275 714 A | 7/1988 |
| EP | 0 343 627 A | 11/1989 |
| EP | 0 834 647 A | 4/1998 |
| GB | 166 740 A | 7/1921 |
| GB | 191 177 A | 1/1923 |
| GB | 503 105 A | 3/1939 |
| GB | 734 268 A | 7/1955 |
| GB | 837 665 A | 6/1960 |
| JP | 2002-155712 | 5/2002 |

* cited by examiner

*Primary Examiner*—Thomas Denion
*Assistant Examiner*—Ching Chang
(74) *Attorney, Agent, or Firm*—Armstrong, Kratz, Quintos, Hanson & Brooks, LLP

(57) ABSTRACT

A valve train for an internal combustion engine including a plurality of cylinders having different valve mechanism constructions, in which the valve train has a correcting member for correcting a difference in valve lift amount that is produced between the plurality of cylinders due to a difference in construction between valve mechanisms so as to make valve lift amounts of the plurality of cylinders substantially uniform.

18 Claims, 6 Drawing Sheets

VALVE TRAIN FOR INTERNAL COMBUSTION ENGINE

BACKGROUND OF THE INVENTION

1. Field of the Invention

The present invention relates to a valve train for an internal combustion engine, and more particularly to a valve train for a multi-cylinder internal combustion engine including a plurality of cylinders in which valve operating characteristics of the respective cylinders are made different.

2. Description of the Related Art

There are proposed techniques for improving the fuel economy of a multi-cylinder engine including a plurality of cylinders by making valve operating characteristics of the respective cylinders different and stopping the actuation of inlet and exhaust valves of part of the cylinders, for example, when the engine is run at low speeds (refer to JP-A-2002-155712).

[Patent Literature No. 1]

JP-A-2002-155712

However, in the event that the constructions of the valve mechanisms provided for the plurality of cylinders are made different in order to make the operating characteristics of the valve mechanisms of the respective cylinders, it is considered that there is caused between the cylinders a difference in amount of lift of cams transmitted to valves which cams are formed on a common camshaft in such a manner as to correspond to the respective cylinders.

This is because when connection switching members are provided on rocker-arms provided between cams and valves of part of the cylinders so that the connection switching members are actuated in accordance with operating conditions of the engine to thereby enable a connection or disconnection between the cams and the valves, due to securing the smooth operation of the switching member for convenient, a locking error between the cams and valves has to be increased when compared with a case where there is provided no such switching member.

In addition, in a case where the rigidity of rocker-arms has to be made different for each cylinder for a convenient layout, because rocker-arms having a lower rigidity tend to deflect and deform largely, this can attribute to a possible cause for generating an error in locking conditions between the cams and the valves among the cylinders.

Namely, in the event that the construction or rigidity of the lift amount transmitting portions between the cams and the valves differs from cylinder to cylinder, there is caused a possibility that an actual valve lift amount differs from cylinder to cylinder. This can be a possible cause for generating a change in the revolution speed of the engine, in particular, when the engine is run at low rotational speeds.

SUMMARY OF THE INVENTION

The invention is made with a view to solving the problems which are inherent in the conventional technique, and a main object thereof is to provide a valve train for an internal combustion engine which can eliminate a difference in valve lift amount among a plurality of cylinders that is caused by a difference in construction or rigidity of valve mechanisms of the cylinders so as to suppress the generation of a change in the revolution speed of the engine.

With a view to attaining the object, according to a first aspect of the invention, there is provided a valve train for an internal combustion engine including: a plurality of cylinders having different valve mechanism constructions, and a correcting member for correcting a difference in valve lift amount that is produced between the plurality of cylinders as a result of a difference in construction between valve mechanisms so as to make valve lift amounts of the plurality of cylinders substantially uniform.

According to the construction, for example, even if a difference in cam lift amount that is transmitted to the valves is generated among the cylinders resulting from a clearance between transmitting members of a variable valve operating characteristics mechanism provided between the cams and the valves, it is possible to align the valve lift amounts of all the cylinders with each other by correcting the difference.

According to a second aspect of the invention, there is provided a valve train for an internal combustion engine including: a plurality of cylinders having different valve mechanism rigidities, and a correcting member for correcting a difference in valve lift amount that is produced between the plurality of cylinders resulting from a difference in strength or rigidity between valve mechanisms so as to make valve lift amounts of the plurality of cylinders substantially uniform.

According to the construction, it is possible to eliminate an error in transmitting a cam lift amount to the valves that would otherwise be caused among the cylinders.

According to a third aspect of the invention, there is provided the valve train for an internal combustion engine as set forth in the first aspect, wherein the correcting member is a difference in cam profile that is provided to correspond to the difference in construction or rigidity of the valve mechanisms.

According to the construction, it is possible to simply correct an error in transmitting a cam lift amount to the valves.

According to a fourth aspect of the invention, there is provided the valve train for an internal combustion engine as set forth in the second aspect, wherein the correcting member is a difference in cam profile that is provided to correspond to the difference in construction or rigidity of the valve mechanisms.

According to a fifth aspect of the invention, there is provided the valve train for an internal combustion engine as set forth in the first aspect, further including: switching members (21*e*, 21*s*) provided only on one of the plurality of cylinders for switching operating conditions of valves by selectively connecting follower rocker-arms (15*i*, 16*i*) actuated by a camshaft so as to actuate the valves and actuating rocker-arms (15*d*, 16*d*) corresponding to cams, wherein the correcting member is a cam profile of the camshaft provided on the one of the cylinders which is formed larger than a cam profile of a camshaft provided on the other cylinder in accordance with a difference in construction of the valve mechanisms.

According to a sixth aspect of the invention, there is provided the valve train for an internal combustion engine as set forth in the second aspect, further including: switching members (21*e*, 21*s*) provided only on one of the plurality of cylinders for switching operating conditions of valves by selectively connecting follower rocker-arms (15*i*, 16*i*) actuated by a camshaft so as to actuate the valves and actuating rocker-arms (15*d*, 16*d*) corresponding to cams, wherein the correcting member is a cam profile of the camshaft provided on the one of the cylinders which is formed larger than a cam profile of a camshaft provided on the other cylinder in accordance with a difference in rigidity of the valve mechanisms.

According to a seventh aspect of the invention, there is provided the valve train for an internal combustion engine as set forth in the fifth aspect, wherein the cam profile of the cam shaft provided on the one of the cylinders is a cam profile that abuts with the actuating rocker-arms (15*d*, 16*d*).

According to an eighth aspect of the invention, there is provided the valve train for an internal combustion engine as set forth in the sixth aspect, wherein the cam profile of the camshaft provided on the one of the cylinders is a cam profile that abuts with the actuating rocker-arms (15*d*, 16*d*).

According to a ninth aspect of the invention, there is provided the valve train for an internal combustion engine as set forth in the fifth aspect, wherein the cam profile that abuts with the follower rocker-arms (15*i*, 16*i*) is a base circle provided on the camshaft.

According to a tenth aspect of the invention, there is provided the valve train for an internal combustion engine as set forth in the sixth aspect, wherein the cam profile that abuts with the follower rocker-arms (15*i*, 16*i*) is a base circle provided on the camshaft.

According to an eleventh aspect of the invention, there is provided the valve train for an internal combustion engine as set forth in the seventh aspect, wherein the cam profile that abuts with the follower rocker-arms (15*i*, 16*i*) is a base circle provided on the camshaft.

According to a twelfth aspect of the invention, there is provided the valve train for an internal combustion engine as set forth in the eighth aspect, wherein the cam profile that abuts with the follower rocker-arms (15*i*, 16*i*) is a base circle provided on the camshaft.

According to a thirteenth aspect of the invention, there is provided the valve train for an internal combustion engine as set forth in the ninth aspect, wherein the follower rocker-arms (15*i*) for actuating the inlet valves and the follower rocker-arms (16*i*) for actuating the exhaust valves abut with the base circle which is common thereover.

According to a fourteenth aspect of the invention, there is provided the valve train for an internal combustion engine as set forth in the tenth aspect, wherein the follower rocker-arms (15*i*) for actuating the inlet valves and the follower rocker-arms (16*i*) for actuating the exhaust valves abut with the base circle which is common thereover.

According to a fifteenth aspect of the invention, there is provided the valve train for an internal combustion engine as set forth in the eleventh aspect, wherein the follower rocker-arms (15*i*) for actuating the inlet valves and the follower rocker-arms (16*i*) for actuating the exhaust valves abut with the base circle which is common thereover.

According to a sixteenth aspect of the invention, there is provided the valve train for an internal combustion engine as set forth in the twelfth aspect, wherein the follower rocker-arms (15*i*) for actuating the inlet valves and the follower rocker-arms (16*i*) for actuating the exhaust valves abut with the base circle which is common thereover.

According to a seventeenth aspect of the invention, there is provided the valve train for an internal combustion engine as set forth in the fifth aspect, wherein the one of the cylinder is disposed forward or rear of the other cylinder.

According to an eighteenth aspect of the invention, there is provided the valve train for an internal combustion engine as set forth in the sixth aspect, wherein the one of the cylinder is disposed forward or rear of the other cylinder.

According to a nineteenth aspect of the invention, there is provided a valve train for an internal combustion engine including: a plurality of cylinders having different valve mechanism constructions, and correcting member for correcting a difference in valve lift amount that is produced between the plurality of cylinders due to a difference in construction between valve mechanisms so as to make valve lift amounts of the plurality of cylinders substantially uniform.

According to a twentieth aspect of the invention, there is provided the valve train for an internal combustion engine as set forth in the nineteenth aspect, further including: switching members (21*e*, 21*s*) provided only on one of the plurality of cylinders for switching operating conditions of valves by selectively connecting follower rocker-arms (15*i*, 16*i*) actuated by a camshaft so as to actuate the valves and actuating rocker-arms (15*d*, 16*d*) corresponding to cams, wherein the correcting member is a cam profile of the camshaft provided on the one of the cylinders which is formed larger than a cam profile of a camshaft provided on the other cylinder in accordance with a difference in the valve mechanisms, and the one of the cylinder is disposed forward or rear of the other cylinder.

DETAILED DESCRIPTION OF THE PREFERRED EMBODIMENTS

Referring to the accompanying drawings, the construction of the invention will be described in detail below.

Figure 1:
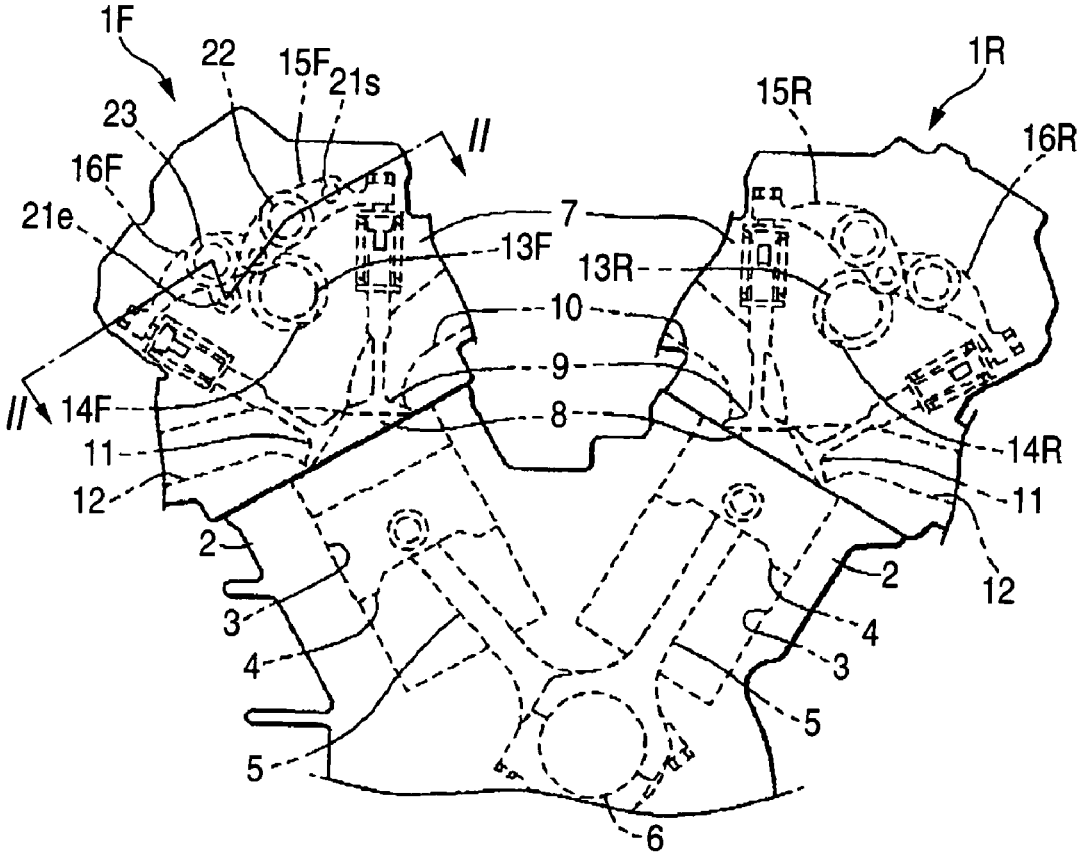
FIG. 1 is a schematic view showing a V-engine to which the invention is applied.

FIG. 1 is a schematic view showing the construction of a V-engine having valve mechanisms to which the invention is applied. This V-engine has two cylinder banks 1F, 1R which are arranged so as to form the letter V, cylinder bores 3 which are formed in cylinder block portions 2 of the both cylinder banks 1F, 1R, pistons 4 which are arranged so as to slide fit in the bores 3, respectively, and a single crankshaft 6 which connects to the respective pistons 4 via connecting rods 5.

Combustion chambers 8, inlet ports 10 of which the communication with the combustion chambers 8 is allowed and disallowed by inlet valves 9 and exhaust ports 12 of which the communication with the combustion chambers 8 is allowed and disallowed by exhaust valves 11 are provided in respective cylinder heads 7 of the two cylinder banks 1F, 1R. Then, lifts of cams 14F, 14R which are arranged in a row, respectively, on camshafts 13F, 13R which are arranged so as to extend in a direction in which cylinders are arranged along an intermediate portion between the inlet valves 9 and the exhaust valves 10 on the respective cylinder banks 1F, 1R are transmitted to the inlet valves 9 and the exhaust valves 11, respectively, via inlet rocker-arms 15F, 15R and exhaust rocker-arms 16F, 16R, whereby the inlet and exhaust valves 9, 11 are driven to be opened and closed in synchronism with the rotation of the crankshaft 6 or, in other words, vertically reciprocating motions of the pistons 4.

Valve operating conditions switching mechanisms 21*e*, 21*s* are incorporated in both the inlet and exhaust rocker-arms 15F, 16F of valve mechanisms on the cylinder bank 1F of the two cylinder banks 1F, 1R for stopping the operation of the inlet and exhaust valves 9, 11 so as to stop combustion cycles for a particular driving condition. The switching mechanisms 21*e*, 21*s* will briefly be described below by reference to FIG. 2.

Figure 2:
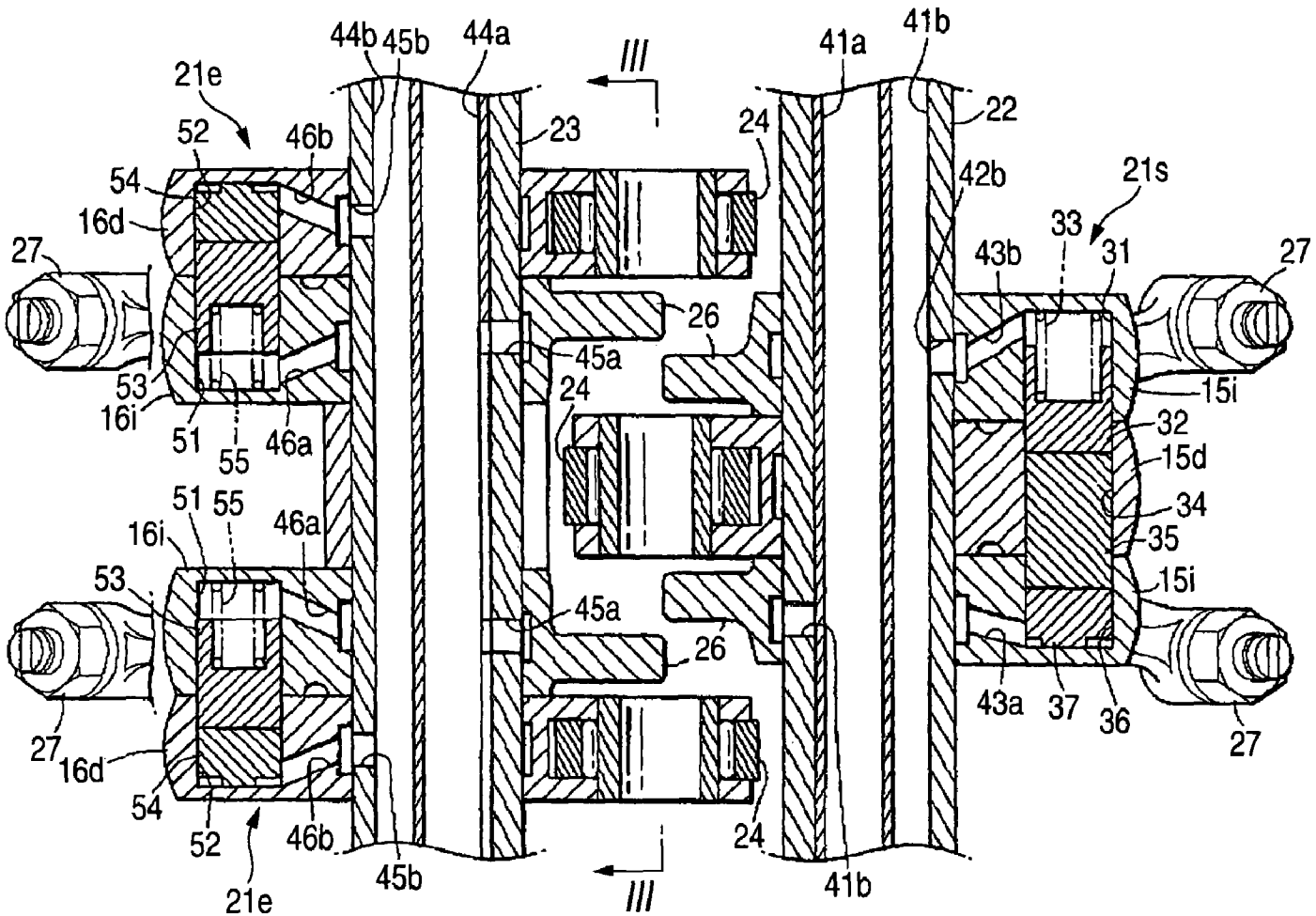
FIG. 2 is a cross-sectional view taken along the line II—II in FIG. 1.

FIG. 2 illustrates valve mechanisms having the switching mechanisms 21*e*, 21*s* for a single cylinder. Note that this mechanism is provided for each of the cylinders on the cylinder bank 1F. In FIG. 2, an inlet rocker shaft which supports the inlet rocker-arms 15F for actuating the inlet valves 9 to open and close and an exhaust rocker shaft 23 which supports the exhaust rocker-arms 16F for actuating the exhaust valves 11 to open and close are arranged to extend in parallel with the direction in which the cylinders are arranged in a row in the cylinder banks in such a manner as to form an inverted triangle together with a single camshaft 13F which constitutes an apex of the triangle. In addition, two inlet valves 9 and two exhaust valves 11 are provided for each cylinder.

Figure 3:
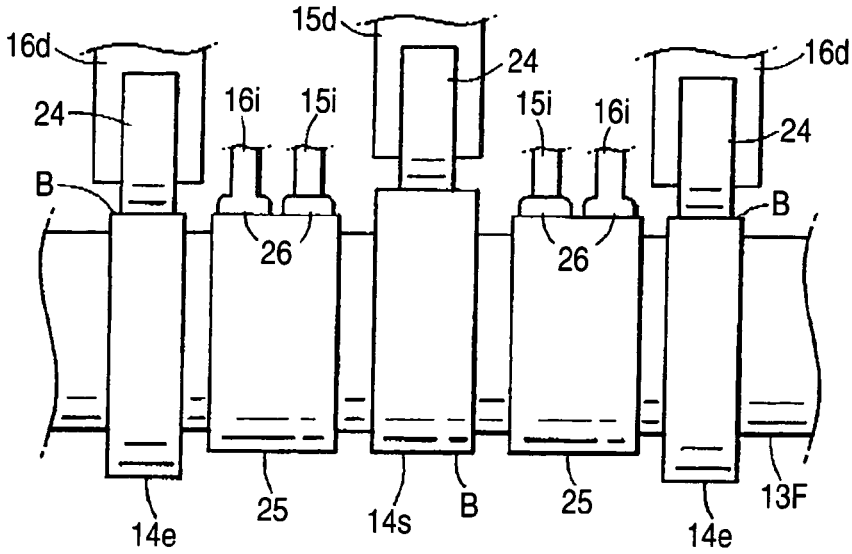
FIG. 3 is a side view in the vicinity of a portion of the engine indicated by the line III—III in FIG. 2.

As shown in FIG. 3, an inlet cam 14*s* for simultaneously actuating the two inlet valves 9 and two exhaust cams 14*e* for actuating the two exhaust valves 11 individually are formed adjacent to each other on the camshaft 13F for each cylinder in such a manner that the single inlet cam 14*s* is held between the two exhaust cams 14*e*.

The inlet and exhaust rocker-arms 15F, 16F for transmitting the lifts of the inlet and exhaust cams 14*s*, 14*e* to the inlet and exhaust valves 9, 11, respectively, are divided into actuating rocker-arms 15*d*, 16*d* for bringing rollers 24 provided at one ends thereof into rolling contact with the corresponding cams 14*s*, 14*e* and follower rocker-arms 15*i*, 16*i* for bringing cam slippers 26 provided at one ends thereof into sliding contact with base circles 25 formed on the camshaft 13F and bringing tappet adjustment screws 27 provided at the other ends thereof into direct abutment with ends of valve stems, and on the inlet valves 9 side, three rocker-arms including a single actuating rocker-arm 15*d* corresponding to the single inlet cam 14*s* and two follower rocker-arms 15*i* corresponding individually to the two inlet valves 9 are pivotally supported on the inlet rocker shaft 22 in such a manner that the single actuating rocker-arm 15*d* is held between the two follower rocker-arms 15*i*. Then, on the exhaust valves 11 side, two actuating rocker-arms 16*d* corresponding individually to the two exhaust cams 14*e* and two follower rocker-arms 16*i* corresponding individually to the two exhaust valves 11 are pivotally supported on the exhaust rocker shaft 23 at symmetrical positions thereon.

A first bottomed guide hole 31 which is made to open at an end thereof which faces towards the central actuating rocker-arm 15*d* is formed in one (an upper one in FIG. 2) of the follower rocker-arms 15*i* of the inlet valves 9 in parallel with an axis of the inlet rocker shaft 22, and a first connecting pin 32 is provided so as to slide fit in the guide hole so formed. This first connecting pin 32 is biased in a spring fashion towards the actuating rocker-arm 15*d* side at all times by means of a compression coil spring 33. A second guide hole 34 is formed to penetrate the actuating rocker-arm 15*d* in such a manner as to be concentric with the first guide hole 31 at a stationary position where the roller 24 abuts with a base circle portion B on the inlet cam 14*s*, and a second connecting pin 35 which is in abutment with the first connecting pin 32 at one end thereof is provided to slide fit in the second hole 34 so formed. Then, a third guide hole 36, which is substantially bottomed as with the aforesaid follower rocker-arm 15*i*, is formed in the other follower rocker-arm 15*i* (a lower one in FIG. 2), and a stopper pin 37, which is made to abut with the other end of the second connecting pin 35 at one end thereof, is provided to slide fit in the third guide hole 36.

Two oil supply passageways 41*a*, 41*b* are formed in the interior of the inlet rocker shaft 22 for sending under pressure lubricating oil pumped up from an oil pan. These two oil supply passageways 41*a*, 41*b* communicate with bottom portions of the first guide hole 31 and the third guide hole 36, respectively, via their corresponding communicating holes 42*a*, 42*b* formed in the pivotally supporting portions of the follower rocker-arms 15*i* and passageway holes 43*a*, 43*b* which are formed in the respective follower rocker-arms 15*i*.

On the exhaust valves 11 side, a first guide hole 51 and a second guide hole 52, which are both bottomed, are formed to extend in parallel with the axis of the exhaust rocker shaft 22 between the actuating rocker-arm 16*d* and the follower arm 16*i* which make a pair at positions which are aligned with each other at the stationary position where the roller 24 abuts with a base circle portion B of the exhaust cam 14*e*, and a connecting pin 53 and a stopper pin 54 are provided so as to slide fit in the holes so formed, respectively. The connecting pin 53 on the follower rocker-arm 16*d* side is biased in a spring fashion towards the actuating rocker-arm 16*i* side at all times by means of a compression coil spring 55.

As in the case with the inlet rocker shaft 22, two oil supply passageways 44*a*, 44*b* are formed in the exhaust rocker shaft 23 for sending under pressure a lubricating oil pumped up from the oil pan, and the oil supply passageways 44*a*, 44*b* so formed communicate with bottom portions of the guide holes 51, 52 via communicating holes 45*a*, 45*b* formed in the respective pivotally supporting portions of both the follower and actuating rocker-arms 16*d*, 16*i* to which they correspond respectively and passageway holes 46*a*, 46*b* provided respectively in both the follower and actuating rocker-arms 16*d*, 16*i*.

The switching mechanisms 21*e*, 21*s* are actuated by controlling electromagnetic valves (not shown) to open and close in accordance with the driving conditions of the engine so as to selectively switch oil pressures sent from the respective oil supply passageways 41*a*, 41*b*, 44*a*, 44*b*. Namely, when an oil pressure is applied to the first guide hole 31 in one of the rocker-arms 15*i* and the respective first guide holes 51 in both the follower exhaust rocker-arms 16*i*, the respective pins which are connected to each other start to move while being assisted by the spring-back force of the compression coil springs 33, 35 as well, and then continue to move to reach a position where the respective pins straddle over the actuating rocker-arm and the follower rocker-arm, whereby there is caused a state where both the actuating and exhaust rocker-arms are connected together into a single unit (a state shown in FIG. 2). Then, on the contrary, an oil pressure is applied to the third guide hole 35 in the other follower rocker-arm 15*i* and the respective second guide holes 52 and in both the actuating exhaust rocker-arms 16*d*, the respective pins which are connected to each other start to move while pressing to compress the compression coil spring 33, 35, and then continue to move to reach a position where the respective pins are allowed to slide fit only in their corresponding guide holes, whereby there is generated a state where the actuating and follower rocker-arms are disconnected from each other.

By this construction, while the engine is idling, in the event that both the actuating and follower rocker-arms of both the inlet and exhaust valves 9, 11 are disconnected from each other, the respective rocker-arms are allowed to be displaced at a certain angle relative to each other, whereby the actuating rocker-arms 15*d*, 16*d* which are actuated, respectively, by the inlet and exhaust cams 14*s*, 14*e* have no effect on the follower rocker-arms 15*i*, 16*i*, and the inlet and exhaust valves 9, 11 are allowed to be kept closed.

In a normal mode where the engine rotates at a predetermined rotational speed or higher, when the oil pressure is applied to the first connecting pin 32 on the inlet side and the second connecting pin 54 on the exhaust side, the respective pins are made to straddle over the adjacent rocker-arms 15*d*, 15*i*, 16*d*, 16*i*. Consequently, both the actuating and follower rocker-arms connected to each other as in a single unit, whereby the two inlet valves 11 and the two exhaust valves 11 are all actuated by the profiles of both the inlet and exhaust cams 14*s*, 14*e*.

Figure 4:
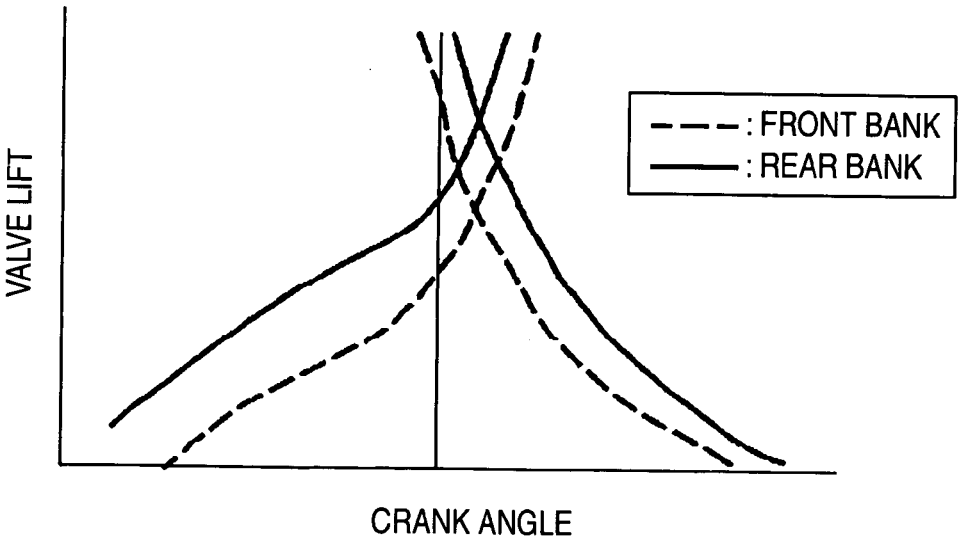
FIG. 4 is a diagram illustrating a valve timing resulting where the invention is not applied.

Thus, as is described heretofore, in this V-engine, because the construction of the valve mechanisms provided on the two banks 1F, 1R is different and the pins incorporated in the switching mechanisms 21*e*, 21*s* in the valve mechanisms provided on the front bank 1F move smoothly in the guide holes, a predetermined clearance is required between the guide holes and the pins. When the construction of the valve mechanisms differs between the pluralities of cylinders, the lift amount of the cams 14F on the front bank 1F that is transmitted to the valves 9, 11 becomes smaller by such an extent that the clearance is provided when compared with the rear bank 1R where switching mechanisms 21*e*, 21*s* are not provided. As a result, when the same camshaft is used on both the front and rear banks 1F, 1R, the valve lift amount (a solid line) of the front bank is caused to differ from the valve lift amount (dotted line) of the rear bank, in particular, in an overlap area of the inlet valve 9 and the exhaust valve 11, as shown in FIG. 4. This can be a cause for generating a change in revolution of the engine in a low-speed area.

In this embodiment, in order to make the valve lift amounts of the plurality of cylinders substantially uniform by correcting the difference in valve lift amount that is generated between the pluralities of cylinders due to the difference in valve mechanism construction, in this embodiment, the profile of the cam lobe of the cam 14F formed on the camshaft 12F on the front bank 1F is made larger than the profile of the cam lobe of the cam 14R formed on the camshaft 14R on the rear bank 1R.

Figure 5:
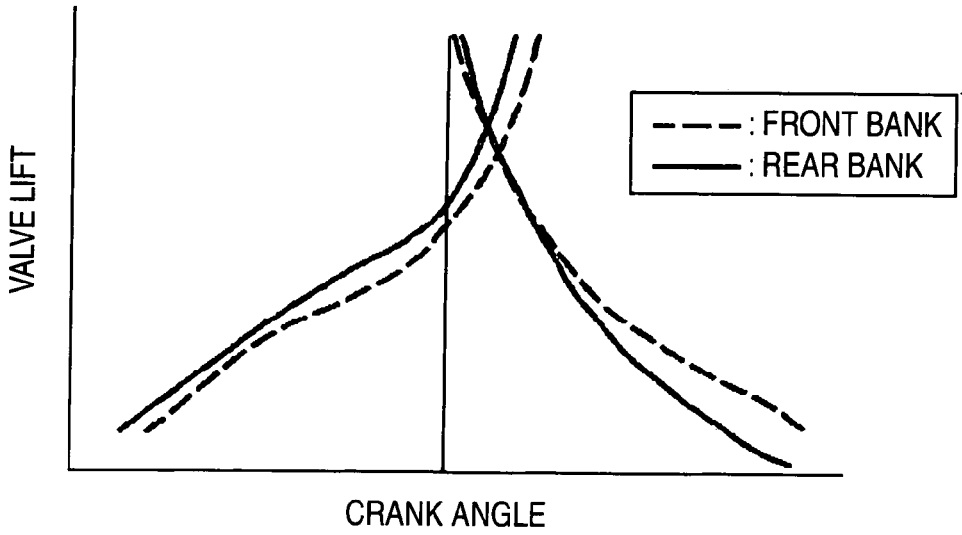
FIG. 5 is a diagram illustrating a timing resulting where the invention is applied.

While each cam is machined by a numerically controlled automatic grinding machine, the generation of a difference in valve lift amount between the both banks 1F, 1R can be suppressed as shown in FIG. 5 by setting in advance appropriately input parameters for camshafts provided on the both banks in accordance with a difference in valve lift amount between the both banks.

Figure 6:
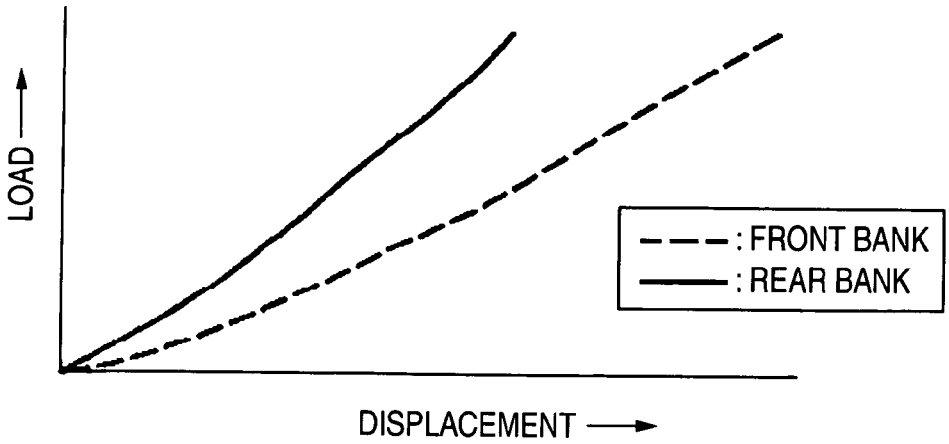
FIG. 6 is a diagram illustrating a load/displacement relationship aimed to be solved according the invention.

In the event that the supporting rigidity of one of the rocker-arms becomes lower than that of the other rocker-arm due to the provision of the oil passageways therein by providing the aforesaid switching mechanisms, there is caused a difference in load/displacement relationship of the rocker-arms between the front and rear banks 1F, 1R, as shown in FIG. 6. Because the difference in rigidity such as this can also cause a difference in valve timing between the both banks 1F, 1R, a certain difference may be provided to cam profiles formed on the camshafts provided on the both banks so as to correct a difference in valve lift amount that is generated between the pluralities of cylinders due to the difference in rigidity of the valve mechanisms to thereby make the valve lift amounts of the pluralities of cylinders substantially uniform.

Thus, the generation of a change in in-cylinder pressure between the front and rear banks 1F, 1R can be suppressed by making substantially uniform the actual valve lift amounts between the different banks. When used herein, the "substantially uniform" means a degree that can suppress a change in in-cylinder pressure between cylinders having valve mechanisms which are different in construction and rigidity, and the actual valve lift amount preferably becomes identical over all the cylinders.

Figure 7:
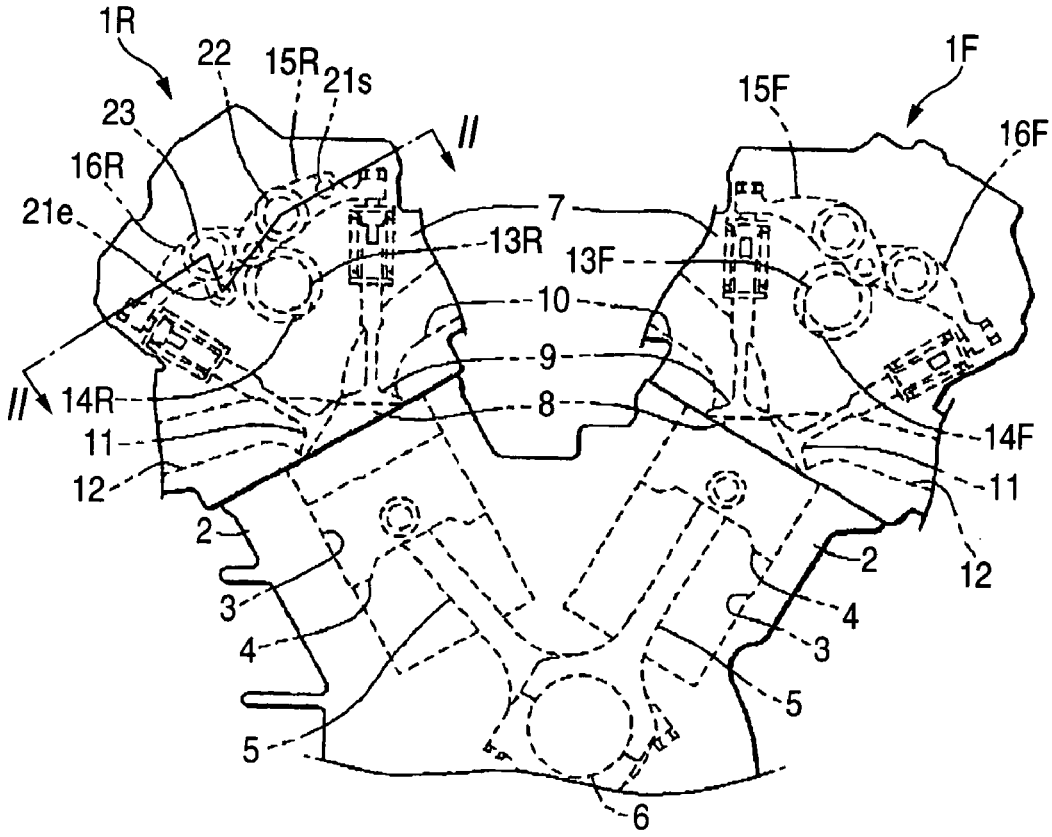
FIG. 7 is another schematic view showing a V-engine to which the invention is applied.
Figure 8:
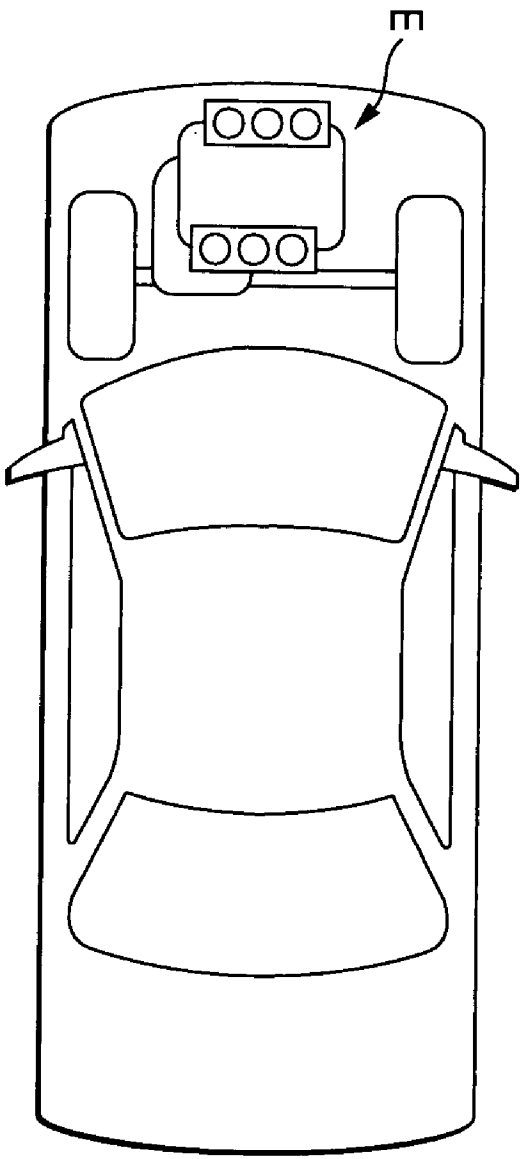
FIG. 8 shows an engine provided on a forward side of a vehicle.

Besides, FIG. 7 shows another embodiment wherein a front side and a rear side are inverse to thereof of the embodiment shown in FIG. 1.

Further, FIGS. 4 to 6 are also applied to the embodiment shown in FIG. 7.

In addition, because the cylinders having the valve trains fitted with the switching mechanisms are disposed on the front side of the engine, the increase in temperature of the valve trains on the front side of the engine can be suppressed by means of running air, and hence deformations can be prevented that would be caused by heat. As a result, the decrease in valve lift amount on the valve trains side of which the rigidity is lowered due to the provision of the switching mechanisms, and hence a difference in valve lift amount between the cylinders can be made as small as possible, whereby the cam profiles can be made smaller in size without being made larger than required.

As is described heretofore, a difference in actual valve lift amount that occurs from cylinder to cylinder can be suppressed by setting cam profiles in consideration of the existence of a difference between the cylinders in the construction or rigidity of valve mechanisms or lift amount transmitting portions provided between cams and valves. Consequently, according to the invention, there can be provided a great advantage in further enhancement of the smoothness in engine revolutions, in particular, in a low-speed driving area.

In addition, according to the invention, by disposing the cylinders provided with the valve trains fitted with the switching mechanisms on the front side of the engine, the increase in temperature of the valve trains on the front side of the engine can be suppressed by means of running air, and deformations can be prevented that would be caused by heat. As a result, the decrease in valve lift amount on the valve trains side of which the rigidity is lowered as a result of the provision of the switching mechanisms, and hence a difference in valve lift amount between the cylinders can be made as small as possible, whereby the cam profiles can be made smaller in size without being made larger than required.

In an engine which is located traverse with respect to a longitudinal direction of a vehicle, if a valve operating conditions switching mechanism is provided on a front bank side, it is possible to perform a maintenance of a valve train from a front side with a space.

Further, if a valve operating conditions switching mechanism is provided on a rear bank side, since it is possible to stop a bank side nearer a drivers' seat, it is possible to reduce an effect of noise to the driver's seat.

Still further, because a constantly driven bank is located at a front side with respect to a traveling direction of a vehicle, it is possible to cool the bank which is more subject to a heat due to constant driving by running wind.

What is claimed is:

1. A valve train for an internal combustion engine comprising:

a plurality of cylinders having different valve mechanism constructions;

a correcting member for correcting a difference in valve lift amount that is produced between the plurality of cylinders as a result of a difference in construction between valve mechanisms so as to make valve lift amounts of the plurality of cylinders substantially uniform;

a cam profile of the camshaft provided on the one of the cylinders which is formed larger than a cam profile of a camshaft provided on the other cylinder in accordance with a difference in construction of the valve mechanisms; and switching members provided only on one of the plurality of cylinders for switching operating conditions of valves by selectively connecting follower rocker-arms actuated by a camshaft so as to actuate the valves and actuating rocker-arms corresponding to cams, wherein the correcting member is a difference in cam profile that is provided to correspond to the difference in construction or rigidity of the valve mechanisms, and wherein a change in in-cylinder pressure generated by a difference in valve lift amount between the plurality of cylinders is corrected by making a cam profile of a cylinder provided with the switching members large.

2. The valve train for an internal combustion engine as set forth in claim 1, wherein the cam profile of the camshaft provided on the one of the cylinders is a cam profile that abuts with the actuating rocker-arms.

3. The valve train for an internal combustion engine as set forth in claim 2, wherein the cam profile that abuts with the follower rocker-arms is a base circle provided on the camshaft.

4. The valve train for an internal combustion engine as set forth in claim 3, wherein the follower rocker-arms for actuating the inlet valves and the follower rocker-arms for actuating the exhaust valves abut with the base circle which is common thereover.

5. The valve train for an internal combustion engine as set forth in claim 1, wherein the cam profile that abuts with the follower rocker-arms is a base circle provided on the camshaft.

6. The valve train for an internal combustion engine as set forth in claim 5, wherein the follower rocker-arms for actuating the inlet valves and the follower rocker-arms for actuating the exhaust valves abut with the base circle which is common thereover.

7. The valve train for an internal combustion engine as set forth in claim 1, wherein the one of the cylinders is disposed at a rear of the other cylinder.

8. The valve train as recited in claim 1, wherein the internal combustion engine is provided with a plurality of cylinder banks, wherein only one of said cylinder banks is provided with said switching members, and wherein the change in in-cylinder pressure between the cylinder banks is corrected by making the cam profile of the cylinder bank provided with said switching members greater than the cam profile of any one of the other cylinder banks.

9. A valve train for an internal combustion engine comprising:

a plurality of cylinders having different valve mechanism rigidities; and a correcting member for correcting a difference in valve lift amount that is produced between the plurality of cylinders as a result of a difference in strength between valve mechanisms so as to make valve lift amounts of the plurality of cylinders substantially uniform;

a cam profile of the camshaft provided on the one of the cylinders which is formed larger than a cam profile of a camshaft provided on the other cylinder in accordance with a difference in strength of the valve mechanisms; and switching members provided only on one of the plurality of cylinders for switching operating conditions of valves by selectively connecting follower rocker-arms actuated by a camshaft so as to actuate the valves and actuating rocker-arms corresponding to cams, wherein the correcting member is a difference in cam profile that is provided to correspond to the difference in construction or rigidity of the valve mechanisms, and wherein a change in in-cylinder pressure generated by a difference in valve lift amount between the plurality of cylinders is corrected by making a cam profile of a cylinder provided with the switching members large.

10. The valve train for an internal combustion engine as set forth in claim 9, wherein the cam profile of the camshaft provided on the one of the cylinders is a cam profile that abuts with the actuating rocker-arms.

11. The valve train for an internal combustion engine as set forth in claim 10, wherein the cam profile that abuts with the follower rocker-arms is a base circle provided on the camshaft.

12. The valve train for an internal combustion engine as set forth in claim 11, wherein the follower rocker-arms for actuating the inlet valves and the follower rocker-arms for actuating the exhaust valves abut with the base circle which is common thereover.

13. The valve train for an internal combustion engine as set forth in claim 9, wherein the cam profile that abuts with the follower rocker-arms is a base circle provided on the camshaft.

14. The valve train for an internal combustion engine as set forth in claim 13, wherein the follower rocker-arms for actuating the inlet valves and the follower rocker-arms for actuating the exhaust valves abut with the base circle which is common thereover.

15. The valve train for an internal combustion engine as set forth in claim 9, wherein the one of the cylinders is disposed at a rear of the other cylinder.

16. The valve train as recited in claim 9, wherein the internal combustion engine is provided with a plurality of cylinder banks, wherein only one of said cylinder banks is provided with said switching members, and wherein the change in in-cylinder pressure between the cylinder banks is corrected by making the cam profile of the cylinder bank provided with said switching members greater than the cam profile of any one of the other cylinder banks.

17. A valve train for an internal combustion engine, comprising:

a plurality of cylinders having different valve mechanism constructions; and a correcting member for correcting a difference in valve lift amount that is produced between the plurality of cylinders as a result of a difference in construction between valve mechanisms so as to make valve lift amounts of the plurality of cylinders substantially uniform;

switching members provided only on one of the plurality of cylinders for switching operating conditions of valves by selectively connecting follower rocker-arms actuated by a camshaft so as to actuate the valves and actuating rocker-arms corresponding to cams, wherein the correcting member is a cam profile of the camshaft provided on the one of the cylinders which is formed larger than a cam profile of a camshaft provided on the other cylinder in accordance with a difference in the valve mechanisms, wherein the one of the cylinders is disposed at a rear of the other cylinder, and wherein a change in in-cylinder pressure generated by a difference in valve lift amount between the plurality of cylinders is corrected by making a cam profile of a cylinder provided with the switching members large.

18. The valve train as recited in claim 17, wherein the internal combustion engine is provided with a plurality of cylinder banks, wherein only one of said cylinder banks is provided with said switching members, and wherein the change in in-cylinder pressure between the cylinder banks is corrected by making the cam profile of the cylinder bank provided with said switching members greater than the cam profile of any one of the other cylinder banks.

* * * * *